United States Patent [19]

Colombo

[11] Patent Number: 4,498,520

[45] Date of Patent: Feb. 12, 1985

[54] APPARATUS FOR THE CONTINUOUS CASTING OF METALS

[75] Inventor: Piero Colombo, Udine, Italy

[73] Assignee: Continua International Continuous Casting S.p.A, Ferrara, Italy

[21] Appl. No.: 343,817

[22] Filed: Jan. 29, 1982

[30] Foreign Application Priority Data

Jan. 30, 1981 [IT] Italy ..... 12426 A/81

[51] Int. Cl.[3] ..... B22D 11/128

[52] U.S. Cl. ..... 164/426; 164/442

[58] Field of Search ..... 164/441, 442, 447, 448, 164/425, 426, 445, 446, 483, 484

[56] References Cited

U.S. PATENT DOCUMENTS

| | | | |
|---|---|---|---|
| 2,176,990 | 10/1939 | Crampton | 164/425 |
| 2,206,888 | 7/1940 | Greenidge | 164/425 X |
| 3,375,107 | 3/1968 | Kranz | 164/484 X |
| 3,520,351 | 7/1970 | Rankin | 164/483 |
| 3,605,866 | 9/1971 | Kleinhagauer | 164/425 |
| 3,918,514 | 11/1975 | Schoffmann | 164/442 X |

FOREIGN PATENT DOCUMENTS

| | | | |
|---|---|---|---|
| 634470 | 1/1962 | Canada | 164/442 |
| 195046 | 5/1957 | Fed. Rep. of Germany | 164/445 |
| 2951193 | 7/1980 | Fed. Rep. of Germany | 164/441 |
| 1108501 | 4/1968 | United Kingdom | 164/425 |

*Primary Examiner*—Kuang Y. Lin

*Attorney, Agent, or Firm*—King, Liles and Schickli

[57] ABSTRACT

Apparatus for the continuous casting of metals, particularly of steel in curved path, in which in the initial portion of the curved path of the casting bar below the mold the bar-guiding means are missing. According to the invention, in the apparatus of this type the casting bar-guiding means provided only in the final portion of the curved path of the casting bar, upstream of the withdrawing and straightening mechanism, comprise at least one pair of powered pulling rollers arranged near their upper, or mold-facing end. To this apparatus there is associated a curved, rigid starter bar which is bent substantially to the same curvature as the curved path of the bar, and is of such a length that when it is positioned to close the mold outlet, it is still engaged between the first pair of powered pulling roller of the casting bar-guiding means provided in the last portion of the curved path of the casting bar, upstream of the withdrawing and straightening mechanism. The spacing between the several successive pairs of powered pulling rollers forming part of the casting bar-guiding means in the last portion of the casting bar curved path, and of the following withdrawing and straightening mechanism including the powered extractor roller pair at the outlet of said mechanism, does not exceed the length of the starter bar, so that the starter bar is always engaged by at least one powered pulling roller pair.

7 Claims, 2 Drawing Figures

9
17
11
7
207
FB
18
120
20
21
222
22
323
223
122
23
123
10

4
5
1
3
2
FB
6
16
15
12
13
14
107
8
11
17
207
9
120
18
BC
19
20
7
10

APPARATUS FOR THE CONTINUOUS CASTING OF METALS

BACKGROUND AND SUMMARY OF THE INVENTION

The invention relates to the apparatus for the continuous casting of metals, particularly of steel, in curved path, i.e. to the apparatus in which the casting bar which is cast in a substantially vertical direction by means of a curved open-ended mold, is at first moved along a curved path from which it departs in a substantially horizontal direction, passing through a reversible withdrawing and straightening mechanism.

In known apparatus for this kind, casting bar-guiding means are provided over the whole curved path along which the casting bar is moved, and are arranged at least on the extrados and intrados sides of the casting. These casting bar-guiding means may be in form of idle rollers, skids, or the like, and their function is to support the casting bar and to counteract the internal ferrostatical pressure which tends to expand the casting bar and to break out its solidified skin. Notwithstanding the provision of the said casting-bar guiding means, the breaking out of the solidified skin of the casting bar often occurs when the casting bar is being moved along its curved path, generally within a zone extending over 1.5–2.0 meters from the mold outlet. When the skin breaks, the molten metal flowing out of the casting will settle and solidify between the casting bar-guiding means and the casting bar, thus forming the so-called drippings which prevent any further withdrawal of the casting bar. Therefore, the cleaning and restoring of the casting path which has been effected by the drippings, must be carried out at the end of the casting operation, which will be however continued with the other casting path or paths of the apparatus. Of course, this involves a longer overall casting time, due to the down times and the hard work to be done between one casting operation and the next.

In order to overcome the said problems, some apparatus have been proposed for the continuous casting of metals in curved path. These apparatus are above all intended for the casting of metal casting bars having small sectional dimensions, such as for example a square section up to 140–150 mm each side. The apparatus are fully devoid of means for guiding the casting in the initial section of its curved path below the mold, more particularly over a distance from at least 1.5–2.0 meters from the cold. Thus the advantage is attained of more easily cleaning and restoring the casting path should the skin of the casting bar break. In fact, since the casting bar is not clamped between the casting bar-guiding means along the initial section of its curved path, the casting operation can be easily resumed on the same casting path by reinserting the starter bar or by using as a starter bar the already cast strand. It is thus possible to attain a higher plant utilization factor and to reduce the down time due to the breaking of the metal casting skin.

Problems arise however, with the elimination of the casting bar-guiding means in the region below the mold since the flexible starter bar is not guided and supported in the last portion of its path. In fact, when a flexible or articulated starter bar is not suitably guided, for example on the extrados side, along the curved path below the mold, as well as during its withdrawal from the mold in the initial stage of the casting operation, this starter bar might become stretched along the chord of the arc described by the curved free path, thus determining an uneven pull and breakage of the casting bar at the outlet of the mold.

To solve the problem of the starter bar to be used in the apparatus for the continuous casting of metals in curved path, in which at least one initial portion, starting from the mold, of the casting bar curved path is devoid of casting bar-guiding means, entirely rigid, curved starter bars have been proposed, with a shape conforming to the casting bar curved path, and of a length corresponding to the length or the arc representing the curved path from the mold outlet to the powered extractor roller pair at the outlet of the withdrawing and straightening mechanism. Obviously, these curved rigid starter bars need not to be guided and supported when they are inserted from below into the mold by the same withdrawing and straightening mechanism. They however have the following disadvantages owing to the distance, which might be rather great, between the withdrawing and straightening mechanism on the one hand, and the mold on the other hand. The starter bar, even if it is of the rigid type, might be subjected to elastic strains and/or movements that hinder the insertion of the starter bar head end from below into the mold outlet. Further the construction of the withdrawing and straightening mechanism, that has the task of taking away and moving into its rest or storage position the curved rigid starter bar, as well as the task of withdrawing the casting bar, and of straightening and delivering same in a substantially horizontal direction, then becomes rather complicated and expensive. Moreover, the entirely rigid, curved starter bar takes up a rather important space when it is removed to its rest or storage position, and auxiliary mechanisms are generally required for bringing and maintaining same in its storage position, and for taking it back to its active position.

The invention aims overcome the afore-disclosed problems by providing an apparatus for the continuous casting of metals, particularly of steel, in curved path, in which an initial portion of the casting bar curved path, immediately below the mold and within the spray-cooling chamber, is devoid of casting bar-guiding means. With the apparatus of the invention, notwithstanding the absence of casting bar-guiding means in said initial portion, it is possible to easily and accurately insert the starter bar into, and withdraw the starter bar from the mold, without any tendency of the starter bar to become stretched along the chord of the curved path, and at the same time without significant difficulties and complications in the construction of the withdrawing and straightening mechanism and the storage means.

According to the invention, the casting bar-guiding means that are provided in the last portion of the casting bar curved path, upstream of the withdrawing and straightening mechanism, comprise at least one pair of powered pulling rollers arranged at, or near to their upper end turned towards the mold, while a rigid and curved starter bar is associated to the apparatus. This starter bar substantially has the same curvature as the casting bar curved path, and such a length that when it is positioned to close the mold bottom outlet, it is still engaged between the first pair of powered pulling rollers in the said casting bar-guiding means provided in the last portion of the casting bar curved path, upstream of the withdrawing and straightening mechanism. Thus, by means of the said first pair of powered pulling rollers and of other successive pairs of powered pulling rollers which might be included in the said casting bar-guiding means, and/or in the withdrawing and straightening mechanism, the starter bar can be moved forward up to being engaged between the powered extractor roller pair at the outlet of the withdrawing and straightening mechanism.

The main advantage afforded by the invention resides in the fact that it is possible to use a curved rigid starter bar much shorter than the starter bars which have been used up to now in the apparatus for the continuous casting of metals in curved path, with no casting bar-guiding means in an initial portion below the mold of the casting bar curved path.

In the last portion of the casting bar curved path, between the first pair of powered pulling rollers of the casting bar-guiding means and the last pair of powered pulling or extractor rollers of the withdrawing and straightening mechanism, there might be provided one or more further pairs of powered pulling rollers. The spacing between the several successive pairs of powered pulling rollers forming part of the casting bar-guiding means provided in the last portion of its curved path, and/or of the following withdrawing and straightening mechanism, including the pair of powered extractor rollers at the outlet of said withdrawing and straightening mechanism, does not exceed the length of the starter bar, so that the starter bar is always engaged by at least one pair of powered pulling rollers. The length of the curved rigid starter bar therefore is substantially equal to the distance between the lower mold outlet and the first powered roller pair of the casting bar-guiding means in the last portion of the casting bar curved path, or to the smallest distance between two successive pairs of powered pulling rollers forming part of the said casting bar-guiding means and/or of the withdrawing and straightening mechanism.

In one preferred embodiment of the invention, the casting bar-guiding means are provided only in correspondence with the second half of the casting bar curved path, and the first pair of powered pulling rollers is located at the upper or mold-facing end of said means at a position substantially midway of the arc described by the casting bar curved path, between the mold and the withdrawing and straightening mechanism. In this case, the length of the starter bar is substantially equal to the half of the casting bar curved path from the mold to the withdrawing and straightening mechanism.

The curved, rigid, short starter bar according to the invention may be made of any suitable material, such as for example steel, aluminium, or a light alloy.

The powered pulling roller pair or pairs provided according to the invention in the casting bar-guiding means situated in the last portion of the casting bar curved path, may be operated in any desired manner, for example through a suitable drive taking its power from the withdrawing and straightening mechanism, or else by means of one or more special motors which are synchronized with the motor for driving the said mechanism. Moreover, the two powered pulling rollers in each one of the said roller pairs may be mounted in such a manner that they can be drawn away from, and near to each other, substantially in the radial direction of the casting bar curved path, whereby they are drawn near to each other in order to apply on the starter bar a sufficient pressure for a good and safe grip of the casting bar, while they are drawn away from each other in order to reduce the pressure on the only partly solidified casting bar, so as to avoid any crushing of same.

Apart from the above disclosed features, the casting bar-guiding means provided in the last portion of the casting bar curved path may be constructed in any desired manner, and may comprise idle rollers and/or skids and/or sliding shoes at the intrados and/or at the extrados. It might be even sufficient to have only two casting bar guiding rollers respectively mounted on the intrados, and the extrados side of the casting bar curved path in a facingly arranged relation, downstream of, and preferably the nearest possible to the first powered pulling roller pair.

According to one preferred embodiment of the invention, when all the pairs of superposed rollers in the withdrawing and straightening mechanism or at least those pairs situated in the last section of said mechanism, are of the openable type and constructed in such a manner that the superposed rollers belonging to the same roller pair can be drawn away from each other, the starter bar can be moved into its rest or storage position at least partly in the area of the withdrawing and straightening mechanism, whereby the space taken up by the continuous casting apparatus is considerably reduced, both in length and in height. More particularly, the rollers of all the openable roller pairs of the withdrawing and straightening mechanism, or at least the rollers of the openable roller pairs provided in the last section thereof and possibly only the rollers of the last pair of openable, powered extractor rollers of said withdrawing and straightening mechanism are supported on cantilever means. The structure for supporting the starter bar in its storage position is then provided alongside the path of removal of the starter bar, on the free side of the cantilever rollers. With such an arrangement, the starter bar will be disengaged from the rollers of the said openable roller pairs, by drawing these rollers away from each other, and will be pushed from the side outwardly of the casting path into its storage position on the starter bar supporting structure, while it will be engaged between said openable roller pairs when it is pushed inwardly from the side, in readiness for being inserted into the mold outlet.

BRIEF DESCRIPTION OF THE DRAWINGS

These and other features of the invention and the advantages arising therefrom will appear evident from the following specification of one preferred embodiment which is shown by way of a non-limiting example in the accompanying drawing, in which.

DESCRIPTION OF THE PREFERRED EMBODIMENT OF THE INVENTION

Figure 1:
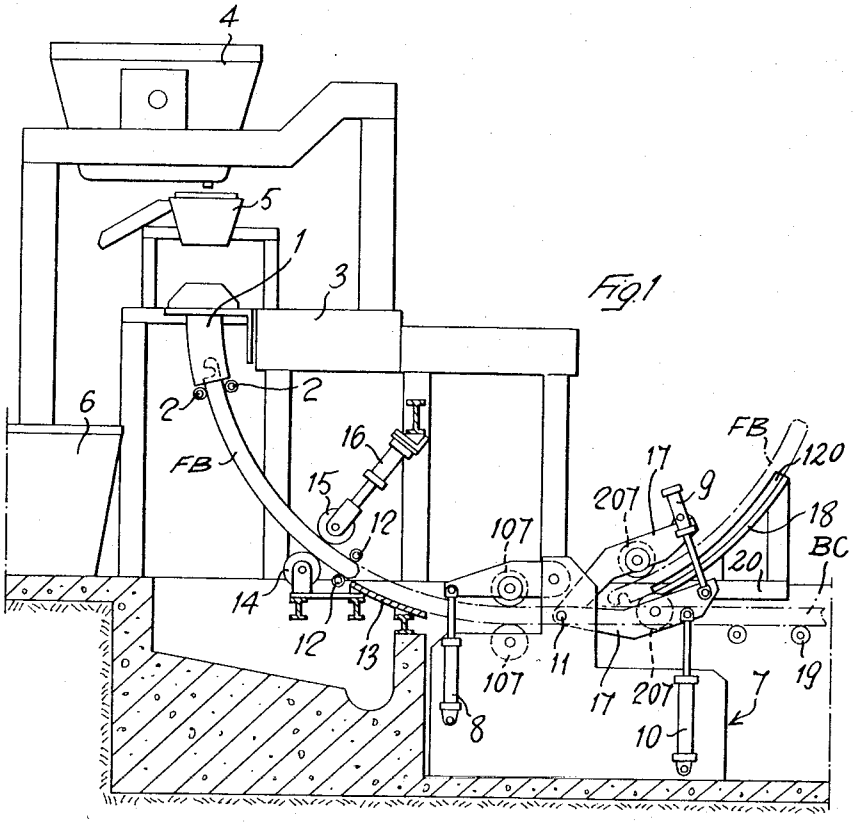
FIG. 1 diagrammatically shows in side elevation an apparatus for the continuous casting of metals in curved path, according to the invention.

Referring to FIG. 1, numeral 1 denotes the open mold of an apparatus for the continuous casting of metals, including steel, particularly to form bars of square cross-section up to about 150 mm each side. The mold 1 is of the curved type and is connected to the bottom rollers 2 provided at its lower outlet, and might be followed by a curved short cage of guide rollers connected with or separated and independent from mold 1.

The mold 1 is of the rocking type and is actuated by a rocking unit 3. A ladle 4 pours the molten metal into an underlying intermediate tundish 5 that on turn generally pours the metal into a plurality of underlying molds 1 each associated to a casting path. Numeral 6 indicates a bucket whereinto the molten metal can be poured from the intermediate tundish 5 in case of emergency.

The metal casting bar issuing from the bottom outlet of mold 1 substantially in a vertical or nearly vertical direction moves along a curved path, generally along an arc of circumference, and departs therefrom in a substantially horizontal direction. At the end portion of said curved path, between it and the adjacent straight horizontal path of the casting, there is located the withdrawing and straightening mechanism 7 comprising a first pair of powered rollers 107 and a second pair of powered rollers 207. The rollers 107 can be pressed the one towards the other by means of a hydraulic or pneumatic actuator cylinder 8. The rollers 207 known as extractor rollers, are located at the outlet of the withdrawing and straightening mechanism 7 and are pressed towards each other by means of a hydraulic or pneumatic actuator cylinder 9. The rollers 207 can be lifted and lowered simultaneously, for instance, angularly about pivot 11, by means of a further hydraulic or pneumatic actuator cylinder 10. The withdrawing and straightening mechanism 7 is of the reversible type, whereby it can not only withdraw the starter bar and the metal casting from the mold 1, but also insert the starter bar from below into the mold 1.

The initial portion of the curved path along which moves the metal casting bar, that is the portion immediately below the mold 1, which is situated within the spray cooling chamber (not shown), and which may extend for example over a length, or rather height, of about 1.5–2.0 meters, is entirely without means for guiding the casting. In the remaining portion of the said curved path, beneath the spray cooling chamber and up to the withdrawing and straightening mechanism 7, casting bar-guiding means are instead provided, which may be made in any desired manner, and may consist, for example, of two idle rollers 12 oppositely arranged at the intrados and extrados sides, respectively, and of one or more skids 13 at the extrados side.

At their end turned towards the mold 1, the said casting bar-guiding means comprise a pair of powered pulling rollers 14, 15 with reversible direction of rotation. These powered rollers 14, 15 are capable to grip in between them the starter bar FB so as to move the same upwardly, towards the mold 1, or downwardly, towards the straightening and withdrawing mechanism 7. One of these pulling rollers, for instance the roller 14 on the extrados side, is fitted in a stationary support member, while the opposite pulling roller, such as the roller 15 on the intrados side, can be drawn near to, and away from the other roller 14, for example by the aid of a hydraulic or penumatic cylinder 16. Through a suitable drive, (not shown) both pulling rollers 14, 15 may be operated by the main motor of the withdrawing and straightening mechanism 7 or by one of the powered rollers of this mechanism. They may be also actuated by their own distinct motors or by their own common motor, the said motor or motors being electrically synchronized with the motor of the withdrawing and straightening mechanism 7. The powered pulling roller pair 14, 15 is located approximately at mid-length of the curved path from the mold 1 to the withdrawing and straightening mechanism 7. The curved path portion between the mold 1 and the pair of powered pulling rollers 14, 15 is devoid of casting bar guiding means.

The said casting bar-guiding means 12, 13 are displaced sideward of the axis of mold 1, by an extent which is sufficient for preventing them from being affected by any splashes of metal, when the solidified skin of the metal casting breaks in the spray cooling chamber or thereabove. These means may be also protected against the said splashes of metal by means of suitable shields (not shown).

Figure 2:
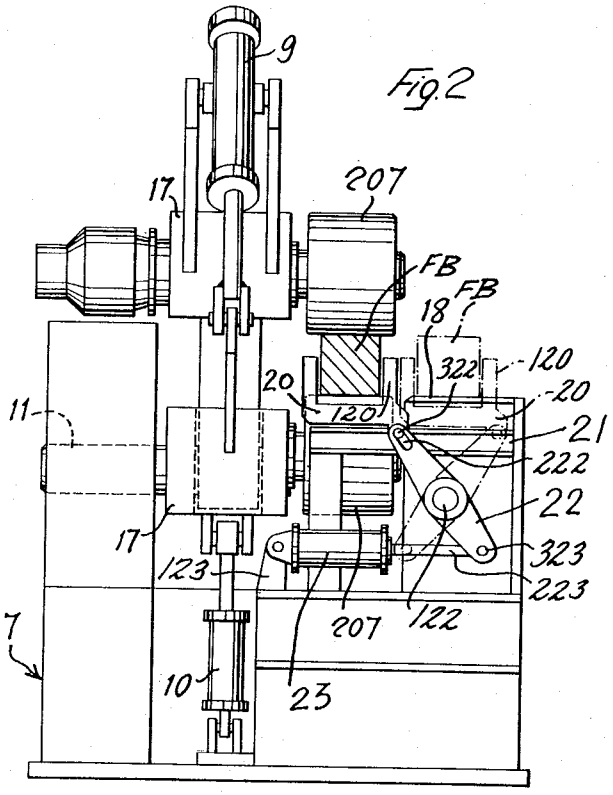
FIG. 2 is a part-sectional detail view in an enlarged scale of said apparatus showing the powered extractor rollers at the outlet of the withdrawing and straightening mechanism.

The powered extractor rollers 207 at the outlet of the withdrawing and straightening mechanism 7 are carried in a cantilevered manner by the respective rocking arms 17 which are pivotally mounted as in 11 onto the frame of the withdrawing and straightening mechanism 7, as it is apparent in FIG. 2. Just behind the roller pair 207, a slide 20 is slidably supported on guide rails 21 for a reciprocating movement in a direction transverse to the feed direction of the starting bar FB, at one side of the roller way 19. On the slide 20 a curved, cradle like, upwardly extending support member 18 is secured for movement with the slide 20, provided with side walls 120. A power cylinder 23 is swingably secured at one end to a lug 123 welded, or otherwise secured, to the machine frame.

Further, a piston (not shown) is slidably housed in cylinder 23, with its piston rod 223 extending outside of cylinder 23.

The free end of the piston rod 223 is pivotably connected at 323 to one end of a lever 22, centrally fulcrumed at 122 to the machine frame. The other end of the lever 22 is provided with an elongated slot 222 in engagement with a pin 322 secured to the slide 20.

Downstream of the withdrawing and straightening mechanism 7, the metal casting bar BC moves along a straight and substantially horizontal path, defined by a roller way 19.

The starter bar which is associated to the above-described apparatus for the continuous casting of metals in curved path consists of a curved, rigid starter bar FB, the bending of which is conformable to the curvature of the curved path along which moves the casting bar from the mold 1 to the withdrawing and straightening mechanism 7. This curved rigid starter bar FB has a length which is slightly longer than the length of the curved path portion between the mold 1 and the powered pulling roller pair 14, 15, and which is also slightly longer than the length of the curved path portion between the said powered pulling roller pair 14, 15 and the next pair of powered rollers 107 of the withdrawing and straightening mechanism 7. The length of the starter bar FB is also slightly longer than the distance between the powered roller pair 107 at the inlet of the withdrawing and straightening mechanism 7 and the powered extractor roller pair 207 at the outlet of the withdrawing and straightening mechanism 7 itself. As a rule, the starter bar FB has such a length that before being fully disengaged from one preceding pair of powered rollers 14, 15 or 107, it comes into engagement with the following pair of powered rollers 107 or 207, or vice-versa. Consequently, the operation is as follows:

In its initial, starting position, shown with solid lines in FIG. 1, the starter bar FB closes with its head end in the bottom outlet of mold 1, while the tail end is engaged between the powered pulling rollers 14, 15, which are pressed the one against the other. Consequently, the starter bar FB is removed from the mold 1 and owing to the action of the powered pulling roller pair 14, 15, is shifted towards the withdrawing and straightening mechanism 7. Thus, the curved rigid starter bar FB guides the initial portion or leading end of the metal casting bar BC, along the proper curved path through the mold-underlying portion which is devoid of casting bar-guiding means, up to engage said end with the casting bar-guiding means 14, 15, 12, 13 provided in the last portion of the said curved path, upstream of the withdrawing and straightening mechanism 7. Little before the leading end of the casting bar BC being engaged between the two powered pulling rollers 14, 15, and after the trailing end of the starter bar FB having been engaged between the two powered rollers 107 at the inlet of the withdrawing and straightening mechanism 7, the pressure between rollers 14, 15 will be released, by drawing the intrados pulling roller 15 away from the extrados pulling roller 14, in order to prevent the only partly solidified casting bar from being squeezed between said rollers 14, 15.

The drawing out of the starter bar FB is now continued, at first through the action of the first pair of powered pulling rollers 107 at the inlet of the withdrawing and straightening mechanism 7 and then through the action of the pair of powered extractor rollers 207 at the outlet of said mechanism. When the head of the starter bar FB, which is engaged with the leading end of the casting bar, comes to be between the two pairs of powered rollers 107 and 207 of the withdrawing and straightening mechanism 7, the powered extractor roller pair 207 is opened through a corresponding opening out of the roller-carrying arms 17. The starter bar FB which is now supported on the support member 18 of the slide 20, is then caused to be transversely pushed sideways toward the exterior by means of the hydraulic cylinder 23 which, through the piston rod 223 and the lever 22 pushes the slide 20 sidewise on the guide rails 21, to the position shown in dash-and dotted lines in FIG. 2. The starter bar FB is thus separated from the metal casting BC, and disengaged from the cantilevered powered rollers 207, and it is moved to its storage position on the supporting surface 18, as shown by dash-and-dot lines in FIGS. 1 and 2. The powered extractor roller pair 207 have been up to now in their uplifted position, in which they guide the starter bar FB along a curved path which is the prolongation of the curved path followed by the starter bar between the mold 1 and the withdrawing and straightening mechanism 7, and which is parallel and coplanar to the lateral surface 18 for supporting the stored starter bar FB. This starter bar supporting surface 18 is bent to the same curvature as the starter bar FB, so as to provide a corresponding bed for the rest of said bar (FIG. 1).

After the starter bar FB having been separated and shifted into its parked position, the powered extractor roller pair 207 provided at the outlet of the withdrawing and straightening mechanism 7 are closed on the casting bar BC being lead into the nip between these rollers, and are brought into their lowered down position, thus straightening and directing the casting bar BC onto the horizontal rollerway 19. The casting operation is then continued in the usual manner.

The insertion of the starter bar FB into the casting path is effected by reversing the above described steps for moving the starter bar into storage position. The stored starter bar is sidewise driven inwardly from its supporting surface 18, so that it is once more engaged between the uplifted, opened extractor roller pair 207. These two rollers 207 are then closed on the starter bar whereby they promote the backward movement of the starter bar towards the mold 1. The starter bar FB is then gripped between, and moved forward towards the mold 1 by the pair of powered rollers 107 at the inlet of the withdrawing and straightening mechanism 7, and then by the pair of powered pulling rollers 14, 15. In the last stage of reinsertion of the starter bar into the bottom of mold 1, the casting bar-guiding rollers 12 act as reaction rollers, so that they guarantee that the starter bar coming out of the pair of powered pulling rollers 14, 15 will be precisely moved along the pre-set curved path through the casting path portion below the mold 1, which is devoid of bar-guiding means, and will be exactly led into the mold 1. The starter bar FB closes the bottom of mold 1, and is stopped still before being disengaged from the pair of powered pulling rollers 14, 15, and preferably also before being disengaged from the underlying bar-guiding idle roller pair 12.

Of course the invention is not limited to the just described and shown embodiment, but it may be widely changed and modified. Thus, for example, the first pair of powered pulling rollers 14, 15 included in the casting bar-guiding means might be provided in any position of the curved metal casting path, after a fraction of said path with no bar-guiding means below the mold 1. Moreover, between the said powered pulling roller pair 14, 15 and the powered extractor roller pair 207 at the outlet of the withdrawing and straightening mechanism 7, any desired number of additional pairs of powered pulling rollers might be provided, at a distance from one another which is slightly less than the length of the starter bar FB. The casting bar-guiding means downstream of the powered pulling roller pair 14, 15 may be constructed in any suitable manner. It is also possible to carry out in several different manners the construction of the means for depositing and storing the starter bar FB in its parked position, as well as of the means provided downstream of the withdrawing and straightening mechanism for handling the starter bar. In each powered roller pair 14, 15, 107, 207, either both or only one of these rollers may be timely operated.

Also the rollers of the additional roller pair or pairs which might be provided in the withdrawing and straightening mechanism, may be of the openable type, that is to say, one of the rollers can be drawn away from the other roller, in the same manner as described for the powered extractor rollers 14, 15. Therefore, when the starter bar is to be shifted into its rest position sidewise of, and in the area of the withdrawing and straightening mechanism, it might be removed to the side of the casting path even in correspondence of this or these openable roller pair or pairs arranged downstream of the said roller pair 14, 15. The structure 18 for supporting the starter bar when in its rest or storage position is then arranged in correspondence of the openable roller pair or pairs lying downstream of the powered extractor rollers 14, 15, so that it will project forwardly of the withdrawing and straightening mechanism to a lesser extent than as shown in FIG. 1 and the overall dimensions of the continuous casting machine are thus reduced. The removal of the starter bar in the area of the withdrawing and straightening mechanism and transversally thereto, and the shiftment of same into its storage position onto a starter bar supporting structure alongside the withdrawing and straightening mechanism, might be advantageously used with any type of starter bar and in any type of apparatus for the continuous casting of metals independently of the other features as disclosed in the above statement and appearing in the appended claims. The whole without departing from the leading principle as set forth hereinabove and as claimed hereinafter.

I claim:

1. An apparatus for the continuous casting of metals in a curved path, comprising:

a mold for producing a casting bar;

a rigid curved starter bar for initiating the casting process;

a reversible withdrawing and straightening mechanism including an inlet end and an outlet end, said withdrawing and straightening mechanism including a pair of powered extractor rollers at said outlet end;

means for supporting said powered extractor rollers in a relatively movable fashion;

means for selectively displacing said powered extractor rollers between an opened and closed position;

means for storing said starter bar laterally adjacent said withdrawing and straightening mechanism after said starter bar has initiated the casting process; and means for transversely shifting said starter bar between a first and second position when said powered extractor rollers are in the opened position, in said first position said starter bar is located out of the casting path supported by said storing means and in said second position said starter bar is located in the casting path for engagement by said powered extractor rollers when in the closed position.

2. An apparatus as recited in claim 1 further including casting bar guide means having at least one pair of powered pulling rollers. said guide means being position upstream from said withdrawing and straightening mechanism between said inlet end thereof and said mold along the curved path so that said at least one pair of powered pulling rollers engages said starter bar when in a mold closing position.

3. An apparatus as disclosed in claim 2, wherein said at least one pair of powered pulling rollers and said pair of powered extractor rollers are positioned so that the distance between each of the powered rollers is less than the starter bar length, thereby insuring that said starter bar is always engaged between at least one pair of powered rollers.

4. An apparatus as disclosed in claim 2, wherein said at least one pair of powered pulling rollers is positioned substantially midway along the curved path between said mold and said withdrawing and straightening mechanism.

5. An apparatus as disclosed in claim 2, wherein said casting bar guide means further comprises idle roller means, said idle roller means being located adjacent to said at least one pair of powered pulling rollers along the curved path between said at least one pair of powered pulling rollers and said withdrawing and straightening mechanism.

6. An apparatus as disclosed in claim 2, further comprising means for adjusting the distance between said at least one pair of powered pulling rollers so as to vary the pressure exerted on said starter and casting bars.

7. An apparatus as disclosed in claim 2, wherein said at least one pair of powered pulling rollers are driven in synchronization with said withdrawing and straightening mechanism.

* * * * *